US006583680B1

(12) United States Patent
Tokudera et al.

(10) Patent No.: US 6,583,680 B1
(45) Date of Patent: Jun. 24, 2003

(54) NONRECIPROCAL CIRCUIT DEVICE AND COMMUNICATIONS DEVICE

(75) Inventors: Hiromu Tokudera, Nagaokakyo (JP); Katsuyuki Ohira, Otsu (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 0 days.

(21) Appl. No.: 09/417,384

(22) Filed: Oct. 13, 1999

(30) Foreign Application Priority Data

Oct. 13, 1998 (JP) ..... 10-290807

(51) Int. Cl.[7] ..... H01P 1/32
(52) U.S. Cl. ..... 333/1.1; 333/24.2
(58) Field of Search ..... 335/4, 5, 104, 335/105; 333/116, 238, 1.1, 24.2

(56) References Cited

U.S. PATENT DOCUMENTS

| | | | | |
|---|---|---|---|---|
| 3,614,675 A | | 10/1971 | Konishi et al. | |
| 4,205,281 A | | 5/1980 | Nagao | |
| 5,068,629 A | | 11/1991 | Nishikawa et al. | |
| 5,629,654 A | * | 5/1997 | Frick | 333/116 |
| 5,903,198 A | * | 5/1999 | Weiss | 333/24.1 |

FOREIGN PATENT DOCUMENTS

| | | |
|---|---|---|
| DE | 3028751 | 2/1981 |
| DE | 4330285 | 3/1995 |
| EP | 0381412 | 8/1990 |
| GB | 2269942 | 8/1992 |
| GB | 2269942 | 2/1994 |
| JP | 7106809 | 4/1995 |
| JP | 8-167804 | 6/1996 |

OTHER PUBLICATIONS

Great Britain Search Report dated Mar. 29, 2000.

Japanese Examination Report dated Jun. 4, 2002, along with the English translation.

* cited by examiner

*Primary Examiner*—Lincoln Donovan
(74) *Attorney, Agent, or Firm*—Keating & Bennett, LLP

(57) ABSTRACT

A nonreciprocal circuit device can be reduced in size by omitting an impedance matching circuit. The nonreciprocal circuit device includes a ferrite member, a plurality of mutually intersecting central conductors disposed in proximity to the ferrite member, and a magnet for applying a DC magnetic field. The plurality of central conductors have lengths of substantially λg/2 or a multiple thereof with respect to a wavelength λg at a usable frequency. One end of each of the central conductors is connected to an input/output terminal, and the other end thereof is disconnected so as to be an electrically open end. Alternatively, the central conductors may have lengths of substantially λg/4 or a multiple thereof, the other ends thereof being grounded.

10 Claims, 10 Drawing Sheets

NONRECIPROCAL CIRCUIT DEVICE AND COMMUNICATIONS DEVICE

BACKGROUND OF THE INVENTION

1. Field of the Invention

The present invention relates to nonreciprocal circuit devices and communications devices used for high-frequency bands, particularly in submillimeter-wave bands.

2. Description of the Related Art

A known example of a nonreciprocal circuit device will be illustrated with reference to FIG. 10. FIG. 10 shows an exploded perspective view of a nonreciprocal circuit device, which is commonly referred to as a "lumped-constant nonreciprocal circuit device".

As shown in FIG. 10, a nonreciprocal circuit device 110 comprises an upper yoke 111 and a lower yoke 112 for forming a closed magnetic circuit, three central conductors 121, 122, and 123, a ferrite member 120 having the central conductors thereon, a magnet 113 for applying a DC magnetic field to the ferrite member 120 having the central conductors, and a resin case 130. The three central conductors 121, 122, and 123 formed on the ferrite member 120 mutually intersect at an angle of 120° via an insulation film (not shown). One of the ends of each central conductor is an input/output terminal. The other ends thereof are ground terminals and they are all disposed on the lower surface of the ferrite member 120. In the resin case 130, a hole 131 for receiving the ferrite member 120 having the central conductors 121, 122, and 123, recesses 132 and 136 for receiving capacitors 115 and a resistor 114, and input/output connection electrodes 133 for connecting to input/output terminals are formed. In addition, the input/output connection electrodes 133 are connected to respective terminal electrodes 135 on an outer surface of the resin case 130, and an electrode connected to an end of the resistor 114 and the back of the capacitor 115 is connected to another terminal electrode 135 on the outer surface of the resin case 130.

The input/output terminal P1' of the central conductor 121 and the input/output terminal P2' of the central conductor 122 are connected to respective input/output connection electrodes 133 formed in the resin case 130 and the top electrodes of two of the capacitors 115, respectively, whereas the input/output terminal P3' of the central conductor 123 is connected to the top electrode of the third capacitor 115 and an electrode of the resistor 114.

FIG. 11 shows an equivalent circuit diagram of the nonreciprocal circuit device 110 having the above structure. The central conductors 121, 122, and 123 formed on the ferrite member 120 serve as inductors, and in order to match the impedance thereof to that of an external circuit, the capacitors 115 are additionally disposed in parallel. The resistor 114 is provided in addition to the central conductor 123 so as to permit the nonreciprocal circuit device 110 to act as an isolator allowing only the signals sent from the input/output terminal P1' to the input/output terminal P2' to pass.

Recently, with the demand for miniaturization of communication equipment, reduction in size of a nonreciprocal circuit device as one of the essential components incorporated therein has also been required.

In the lumped-constant nonreciprocal circuit device 110 described above, however, as shown in the equivalent circuit diagram of FIG. 11, each inductor and each capacitor constitutes a parallel-resonance circuit. Since the resonance frequency f of the circuit is substantially given by the formula $f=1/\{2\pi\cdot(LC)^{1/2}\}$, the higher the frequency of the nonreciprocal circuit device, the smaller the value of LC. As a result, the size of the nonreciprocal circuit device is reduced. For example, in the case of 2 GHz, the size of the nonreciprocal circuit device is approximately 7×7 mm.

In this case, the higher the usable frequency, the smaller the nonreciprocal circuit device, with the result that the requirement for miniaturizing the device as a component used in communication equipment is satisfied. However, there is a problem in the manufacturing of the device. In other words, reduction in size of the nonreciprocal circuit device makes formation and connection of the central conductors complicated, leading to occurrences of variations in the manufacturing process among nonreciprocal circuit devices. Furthermore, the higher the frequency and the smaller the value of LC, the greater the influence of variations in manufacturing on characteristics of the nonreciprocal circuit devices. For instance, assuming that an error of 1 nH of inductance occurs in the manufacturing process, consider the degree of the influence on the nonreciprocal circuit device in the cases in which the initial inductances are 10 nH and 1 nH. That is, if the error in the manufacturing process is equal to 1 nH in both cases, when the initial inductance is 10 nH, the change ratio in the inductance is 10%, whereas when the initial inductance is 1 nH, the change ratio is 100%. Therefore, the smaller the initial inductance, the greater the influence on the resonance frequency, leading to occurrence of greater variations in the frequency characteristics of the nonreciprocal circuit device.

For such a reason, there is a limitation on the frequencies usable with a lumped-constant nonreciprocal circuit device. Consequently, from the manufacturing point of view, approximately 2 GHz is the maximum frequency usable with the lumped-constant nonreciprocal circuit device at present.

On the other hand, a nonreciprocal circuit device usable even in frequency bands above approximately 2 GHz is the distributed-constant nonreciprocal circuit device. As an example of this, a description will be given of a known conventional nonreciprocal circuit device referring to FIG. 12. FIG. 12 shows an exploded perspective view of the conventional nonreciprocal circuit device, which is ordinarily referred to as a "Y-shaped distributed-constant nonreciprocal circuit device".

As shown in FIG. 12, a conventional nonreciprocal circuit device 140 comprises a ferrite member 120*a*, an electrode 150 formed on a surface thereof, a ground electrode formed on a back thereof, and an upper magnet and a lower magnet 142. The electrode 150 formed on the ferrite member 120*a* comprises a resonator 151 resonating in the TM110 mode at the center, and input/output connection electrodes 152, 153, and 154 formed in each of the three different directions from the resonator 151. Between the resonator 151 and the input/output connection electrodes 152, 153, and 154 are formed impedance converters 152*a*, 153*a*, and 154*a* having length of $\lambda/4$ for the purpose of impedance matching. Additionally, the input/output connection electrodes 152, 153, and 154 are provided for being connected to an external circuit.

By applying a DC magnetic field with the upper and lower magnets 142, the nonreciprocal circuit device 140 functions as a circulator, in which signals from an input/output terminal P4' pass through an input/output terminal P5', signals from P5' pass through an input/output terminal P6', and signals from P6' pass through P4'.

In the conventional nonreciprocal circuit device, the resonator formed on the surface of the ferrite member has a substantially circular shape. As a result, at the junction of the input/output connection electrode and the resonator, the electrode width is greatly increased to provide the impedance converter. Impedance matching would be impossible between the input/output connection electrode and the resonator, if they were connected directly without the impedance converter. Thus, in the conventional art, as shown in FIG. 12, in order to achieve impedance matching, the impedance converter must be connected to the input/output connection electrode near the resonator. Consequently, this leads to an increase in size of the nonreciprocal circuit device.

SUMMARY OF THE INVENTION

The above-described problems are solved by the present invention. The present invention provides a nonreciprocal circuit device capable of being manufactured for use in frequency bands of approximately 2 GHz or higher without adding an impedance converter or the like.

To this end, according to a first aspect of the present invention, there is provided a nonreciprocal circuit device including a magnetic body, a plurality of mutually intersecting central conductors disposed in proximity to the magnetic body, and a magnet for applying a DC magnetic field, in which the plurality of central conductors have lengths of substantially $n \cdot \lambda g/2$ (n=a natural number) with respect to a wavelength $\lambda g$ at a usable frequency. An end of each central conductor is an input/output terminal connected to an input/output, whereas the other end thereof is disconnected and therefore is an electrically open end.

In this arrangement, the length of each central conductor is set to be substantially $n \cdot \lambda g/2$ (n=a natural number) with respect to a wavelength $\lambda g$ at a usable frequency, and one of the two ends thereof is an open end. This permits the central conductor to serve as a $\lambda g/2$-wavelength resonator. In other words, by the use of only the central conductor, a circuit equivalent to the parallel-resonance circuit having an inductor and a capacitor as shown in the equivalent circuit diagram of FIG. 11 can be formed. Moreover, by applying the DC magnetic field the nonreciprocal circuit device can be made, and there is no need to add a capacitor. Furthermore, since a narrow strip-line central conductor can be used in this device, no impedance converter need be connected in order to obtain impedance matching between the central conductors and the input/output connection electrodes. Additionally, since one end of each central conductor is an open end, there is no risk of a poor connection at that end. As a result, this contributes to reduction of factors degrading the reliability of a nonreciprocal circuit device.

According to a second aspect of the present invention, there is provided a nonreciprocal circuit device including a magnetic body, a plurality of mutually intersecting central conductors disposed in proximity to the magnetic body, and a magnet for applying a DC magnetic field, in which the plurality of central conductors have lengths of substantially $(2m-1) \cdot \lambda g/4$ (m=a natural number) with respect to a wavelength $\lambda g$ at a usable frequency, and one of the ends of each central conductor is an input/output terminal connected to an input/output, and the other end thereof is a ground terminal connected to a ground.

The length of each central conductor is set to be substantially $(2m-1) \cdot \lambda g/4$ (m=a natural number) with respect to a wavelength $\lambda g$ at a usable frequency, and one end of each central conductor is a ground terminal so as to permit each central conductor to serve as a $\lambda g/4$-wavelength resonator. As a result, for a given frequency, this arrangement can make the length of the central conductor shorter than that in a case where the central conductor serves as a $\lambda g/2$-wavelength resonator. Thus, further miniaturization of the nonreciprocal circuit device can be achieved.

In addition, in the nonreciprocal circuit device according to a third aspect of the present invention, the length of the central conductor may be substantially $\lambda g/2$.

Furthermore, in the nonreciprocal circuit device according to a fourth aspect of the present invention, the length of the central conductor may be substantially $\lambda g/4$.

These arrangements can minimize the size of the nonreciprocal circuit device since the length of the central conductor can be as short as possible.

Furthermore, in one of the nonreciprocal circuit devices described above, at least two of the central conductors have different widths. Since the central conductors mutually intersect with an insulation film therebetween, the respective positional relationships between the magnetic body and the central conductors differ. When there are such differences, effective dielectric constants are also different among the central conductors, with the result that the values of characteristic impedance thereof differ. If the central conductors have the same widths, variations in the characteristics of bandwidths or the like occur among the ports of the nonreciprocal circuit device. In contrast, if the widths of the central conductors are different, the bandwidth characteristics or the like among the ports can be adjusted in any desired way.

Furthermore, according to the present invention, there is provided a communications device including one of the nonreciprocal circuit devices described above, a transmission circuit, a receiving circuit, and an antenna. This permits a compact communications device to be produced.

Other features and advantages of the present invention will become apparent from the following description of the invention which refers to the accompanying drawings.

DESCRIPTION OF EMBODIMENTS OF THE INVENTION

Figure 1:
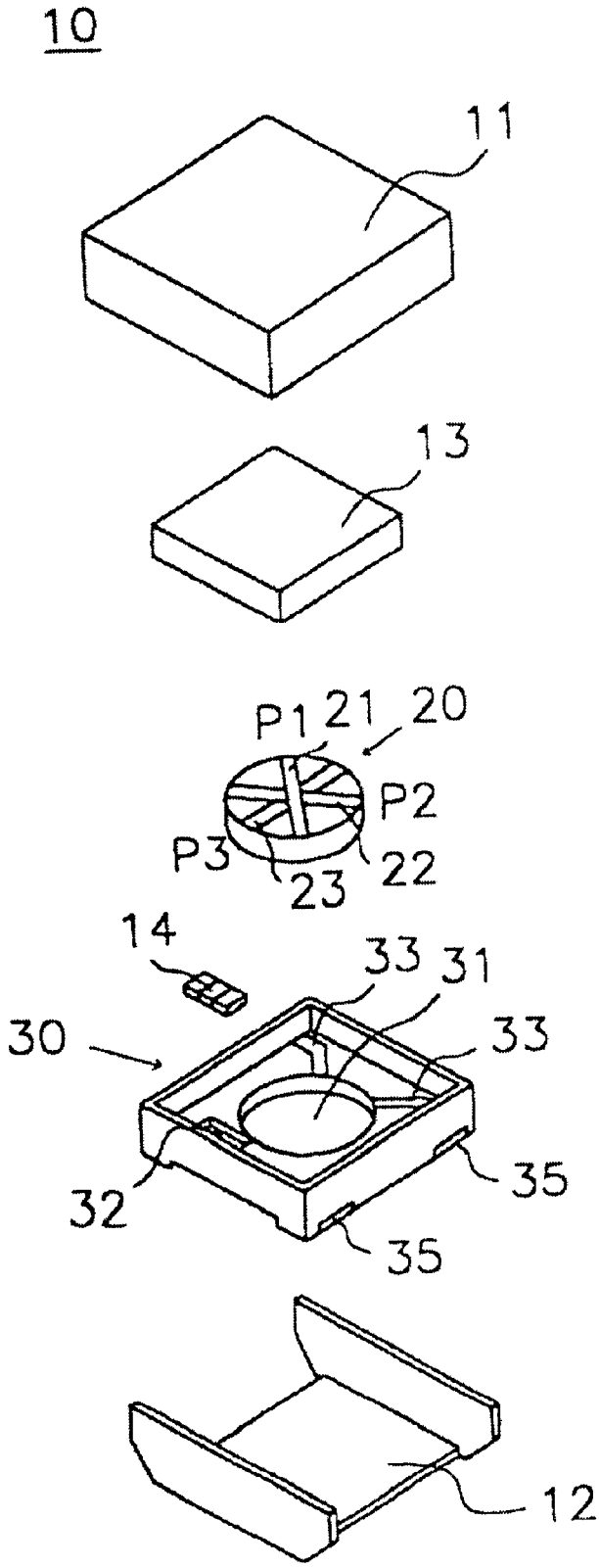
FIG. 1 is an exploded perspective view of a nonreciprocal circuit device according to a first embodiment of the present invention.

FIG. 1 shows a nonreciprocal circuit device used in a first embodiment of the present invention. FIG. 1 is an exploded perspective view of the nonreciprocal circuit device used in the first embodiment.

As shown in FIG. 1, the nonreciprocal circuit device 10 of this embodiment comprises an upper yoke 11 and a lower yoke 12 constituting a closed magnetic circuit, a ferrite member 20 having a ground electrode on the back, three central conductors 21, 22, and 23 formed on a surface of the ferrite member 20, a magnet 13 for applying a DC magnetic field to the ferrite member 20 including central conductors 21, 22, and 23, and a resin case 30. The three central conductors 21, 22, and 23 formed on the ferrite member 20, which are made by a thin-film-forming method such as sputtering, mutually intersect at an angle of 120° and are separated by an insulation film (not shown), which is similarly formed by the thin-film-forming method. An end of each central conductor is an input/output terminal, whereas the other end thereof is an open end. In the resin case 30, a hole 31 for accommodating the ferrite member 20 including the central conductors 21, 22, and 23, a recess 32 for accommodating a resistor 14, and input/output connection electrodes 33 are formed. In addition, the input/output connection electrodes 33 are led as terminal electrodes 35 onto outer surfaces of the resin case 30, and an electrode connected to an end of the resistor 14 is also led as another terminal electrode 35 onto the outer surface of the resin case 30.

The input/output terminal P1 of the central conductor 21 and the input/output terminal P2 of the central conductor 22 are connected to the input/output connection electrodes 33 formed in the resin case 30, whereas the input/output terminal P3 of the central conductor 23 is connected to an electrode of the resistor 14.

In this embodiment, the central conductors 21, 22, and 23 formed on the ferrite member 20 have lengths of $\lambda g/2$ with respect to a wavelength $\lambda g$ at a usable frequency, so that the central conductors 21, 22, and 23 serve as $\lambda g/2$-wavelength resonators. When a DC magnetic field is applied by the magnet 13 disposed on the top of the ferrite member 20, since the resistor is connected to the input/output terminal P3, the nonreciprocal circuit device 10 functions as an isolator allowing only the signals from the input/output terminal P1 to the input/output terminal P2 to pass.

Since the widths of the central conductors 21, 22, and 23 formed on the ferrite member 20 are narrowed and have the prescribed lengths, there is no need to form an impedance converter in order to obtain impedance matching with the input/output connection electrodes 33. Accordingly, when compared with a conventional Y-type nonreciprocal circuit device, since no impedance converter is necessary in the nonreciprocal circuit device used in this embodiment, miniaturization thereof can be achieved. Furthermore, since the other ends of the central conductors 21, 22, and 23 are open ends, the number of connections is less in this embodiment than in the case where they are connected to ground connection electrodes. In this respect, the problem of poor connections does not occur and reliability in manufacturing is thereby increased.

Figure 2:
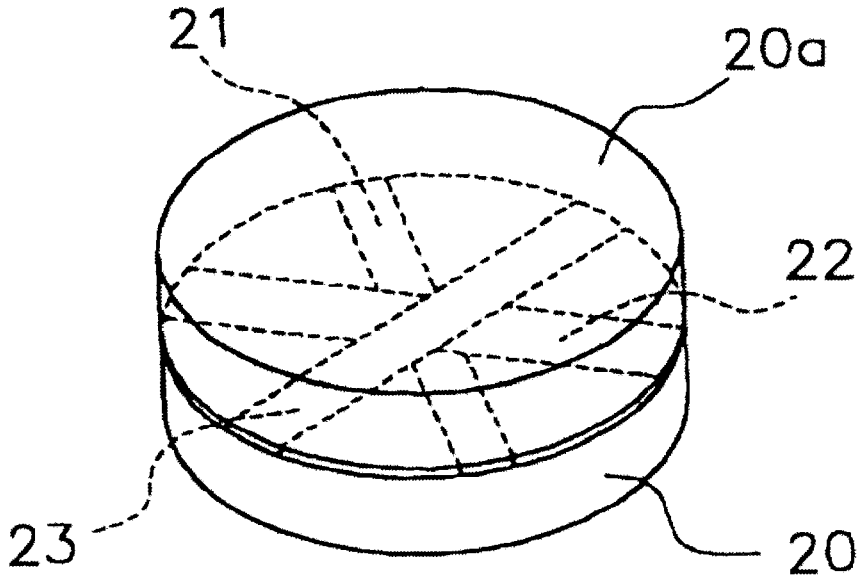
FIG. 2 is a modification of the nonreciprocal circuit device according to the first embodiment of the present invention.

FIG. 2 shows a modification of the first embodiment of the present invention. Since it is nearly the same as the first embodiment described above, only the ferrite member part will be illustrated referring to FIG. 2.

As shown in FIG. 2, this modification has an arrangement such that the three central conductors 21, 22, and 23 are formed to mutually intersect with an insulation film (not shown) on the ferrite member 20 having a ground electrode on the back thereof, and further a ferrite member 20*a* having a ground electrode on the top surface thereof is stacked on the assembly. In this arrangement, the central conductors used in this modification are formed into strip-line types, whereas the central conductors used in the first embodiment are formed into microstrip-line types.

Figure 3:
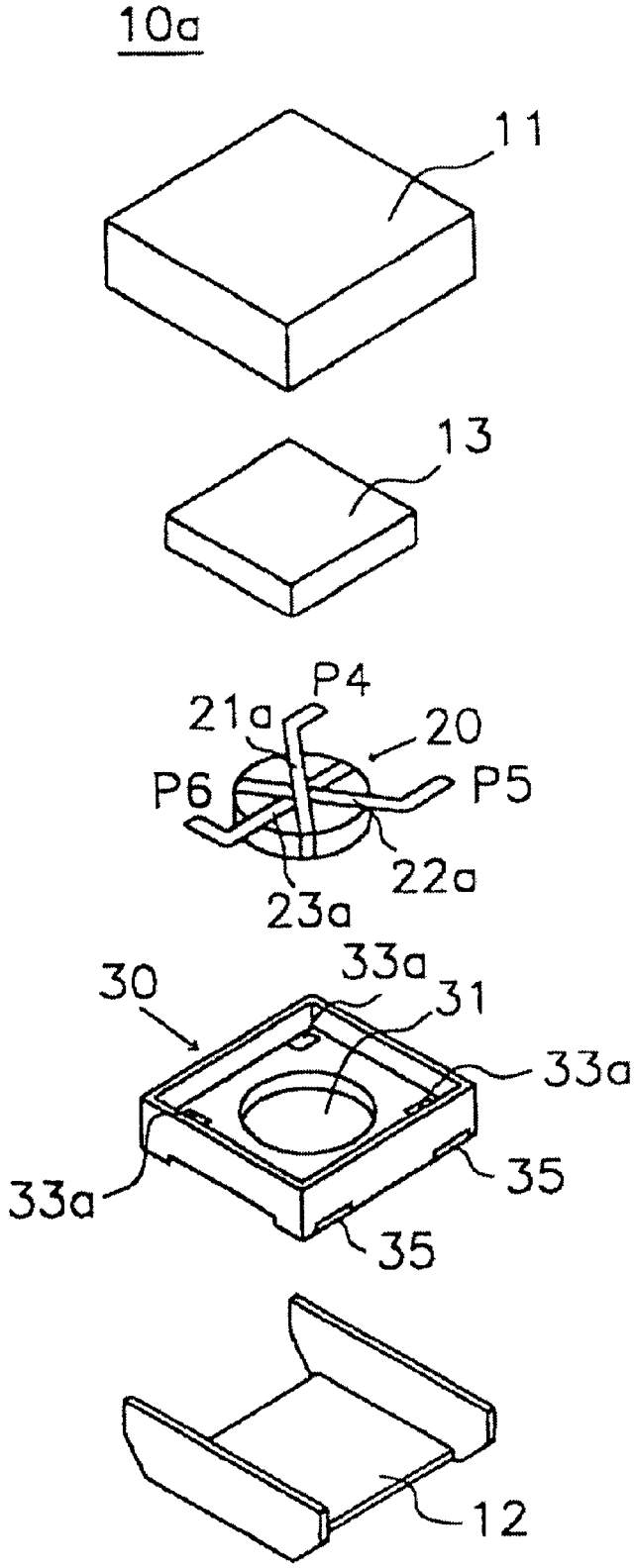
FIG. 3 is an exploded perspective view of a nonreciprocal circuit device according to a second embodiment of the present invention.

Referring now to FIG. 3, a description will be given of a nonreciprocal circuit device according to a second embodiment of the present invention. FIG. 3 shows an exploded perspective view of the nonreciprocal circuit device used in this embodiment. The same parts in this figure as those in the first embodiment are given the same reference numerals, and detailed explanation thereof is omitted.

As shown in FIG. 3, the nonreciprocal circuit device 10*a* in this embodiment comprises an upper yoke 11 and a lower yoke 12 for constituting a closed magnetic circuit, three central conductors 21*a*, 22*a*, and 23*a*, a ferrite member 20 having the central conductors 21*a*, 22*a*, and 23*a* on a surface thereof, a magnet 13 for applying a DC magnetic field to the ferrite member 20 having the central conductors 21*a*, 22*a*, and 23*a* thereon, and a resin case 30. In addition, input/output connection electrodes 33*a* are formed in the resin case 30. The central conductors 21*a*, 22*a*, and 23*a* formed on the ferrite member 20, which are each formed of a metal foil or the like, mutually intersect at an angle of 120° and are separated by an insulation film (not shown). An end of each central conductor is an input/output terminal, and the other end thereof is a ground terminal which is commonly grounded on the back of the ferrite member 20. The metal-foil portion projects from each of the central conductors 21*a*, 22*a*, and 23*a* on the ferrite member 20 to be connected to the input/output connection electrode 33*a*. That is, the metal-foil portion is disposed on the resin case 30 to be connected to the input/output connection electrode 33*a*, the width of the metal-foil portion can be increased or decreased, or the dielectric constant of the part of the resin-case which is disposed under the metal-foil portion, can be changed, so that characteristic impedance can be set to 50Ω in designing the device.

In this embodiment, the lengths of the central conductors 21*a*, 22*a*, and 23*a* formed on the ferrite member 20 are set to be $\lambda g/4$ with respect to a wavelength $\lambda g$ at a usable frequency. This arrangement permits the central conductors 21*a*, 22*a*, and 23*a* to function as $\lambda g/4$-wavelength resonators. When a DC magnetic field is applied by the magnet 13 disposed on the ferrite member 20, the nonreciprocal circuit device 10*a* serves as a circulator allowing the signals from the input/output terminal P4 to the input/output terminal P5, the signals from the input/output terminal P5 to the input/output terminal P6, and the signals from P6 to P4 to pass through.

Figure 4:
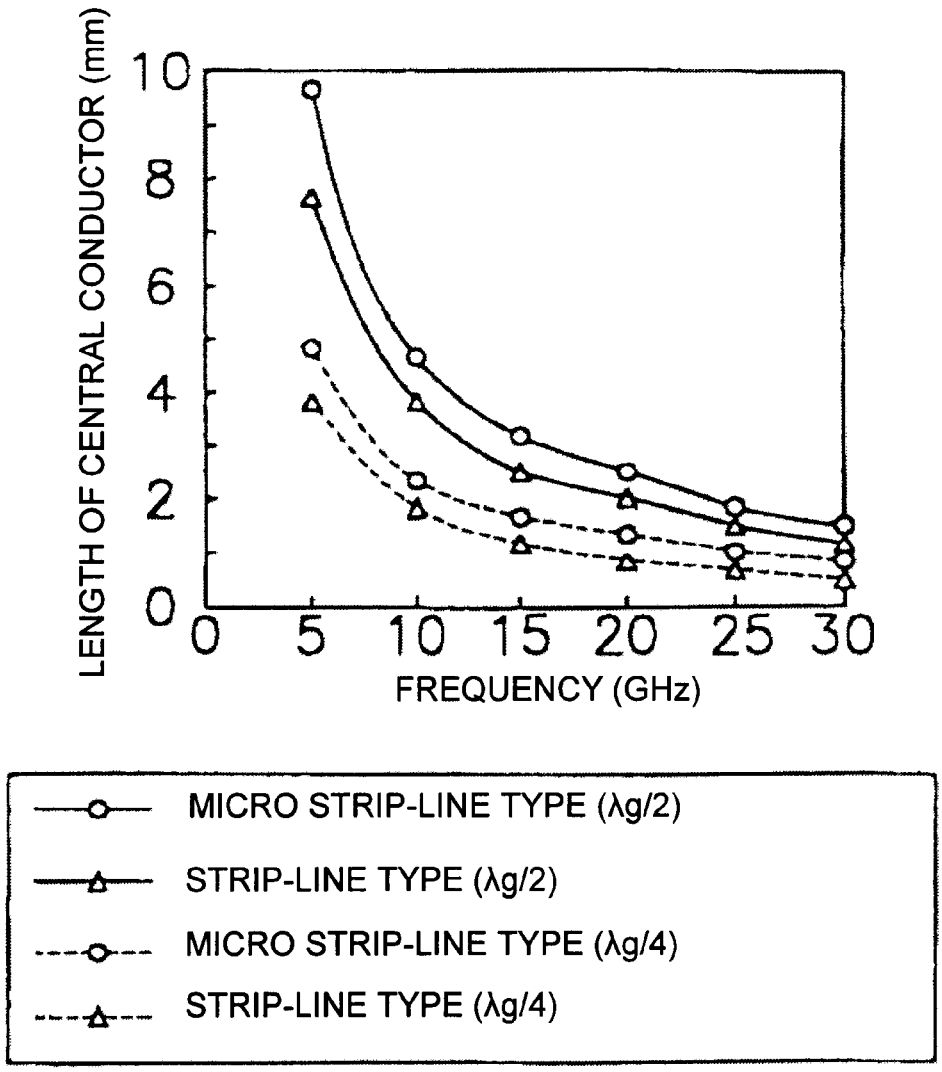
FIG. 4 shows graphs illustrating the relationships between frequencies and the lengths of a central conductor.

The nonreciprocal circuit device can be miniaturized more than that in the first embodiment by setting the length of the central conductors 21*a*, 22*a*, and 23*a* formed on the ferrite member 20 to be $\lambda g/4$ with respect to a wavelength $\lambda g$ at a usable frequency. Regarding this case, FIG. 4 shows graphs for illustrating the relationships between frequencies and the lengths of the central conductors. In FIG. 4, the marks ○ are connected by solid lines to draw the graph of a nonreciprocal circuit device, in which the microstrip-line central conductors have lengths λg/2, as shown in the first embodiment. In addition, the marks Δ are connected by solid lines to draw the graph of a nonreciprocal circuit device, in which the strip-line central conductors have lengths λg/2, as shown in the modification of the first embodiment. Furthermore, the marks ○ are connected by broken lines to draw the graph of a nonreciprocal circuit device, in which the microstrip-line central conductors have lengths λg/4, and the marks Δ are connected by broken lines to draw the graph of a nonreciprocal circuit device in which the strip-line central conductors have lengths λg/4.

As shown in FIG. 4, when the central conductor having a length λg/2 is compared with the central conductor having a length of λg/4 at the same frequency, the length of the central conductor of the latter is half that of the former. Additionally, the strip-line conductor on which the other ferrite member is stacked has a wavelength-reduction effect in which the effective dielectric constant is larger. As a result, when comparisons are made at the same frequency between the strip-line central conductor and the micro-strip-line central conductor, the length of the former is even shorter than that of the latter, so that the nonreciprocal circuit device can be miniaturized.

Furthermore, referring to FIG. 5, a description will be given of a modification of the second embodiment. Since this modification is nearly the same as the second embodiment, only the part of the ferrite member will be illustrated with reference to FIG. 5.

Figure 5:
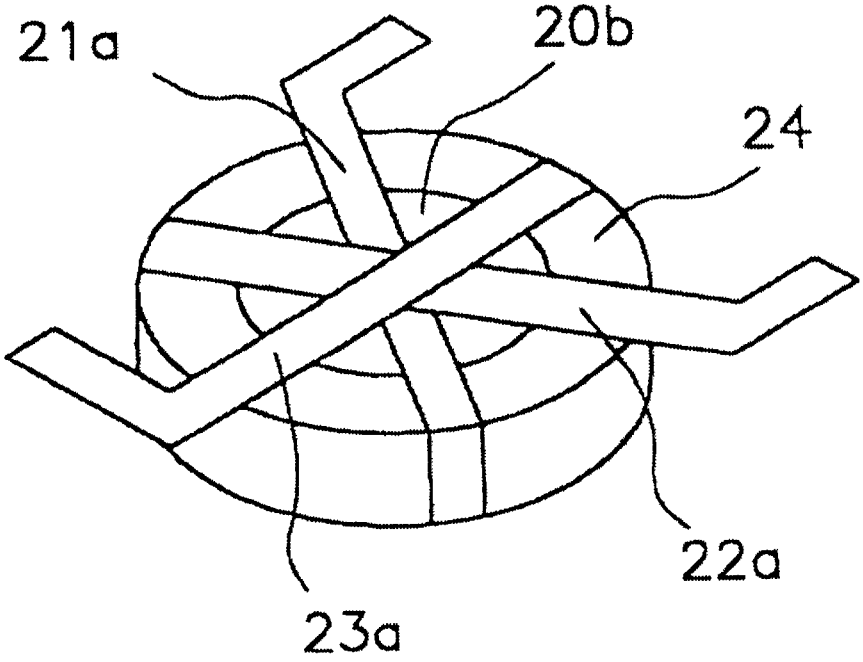
FIG. 5 is a modification of the nonreciprocal circuit device according to the second embodiment of the present invention.

As shown in FIG. 5, the periphery of the ferrite 20*b* in this modification is enclosed by a dielectric member 24 made of, for example, barium titanate, which has a high dielectric constant of approximately 100. In this arrangement, the ferrite member 20*b* is disposed in proximity to the centers of the central conductors 21*a*, 22*a*, and 23*a* in which contribution to the nonreciprocal properties is large, whereas the dielectric member 24 having a high dielectric constant is disposed in proximity to the ends of the central conductors 21*a*, 22*a*, and 23*a* in which contribution to the nonreciprocal properties is small. When compared at the same frequency, at the part of the central electrode in proximity to the dielectric member 24 having a high dielectric constant, the length of the central conductor is shorter, which results from the wavelength-reduction effect due to increase in the effective dielectric constant. Accordingly, further miniaturization of the nonreciprocal circuit device can be achieved while maintaining the nonreciprocal properties.

Figure 6:
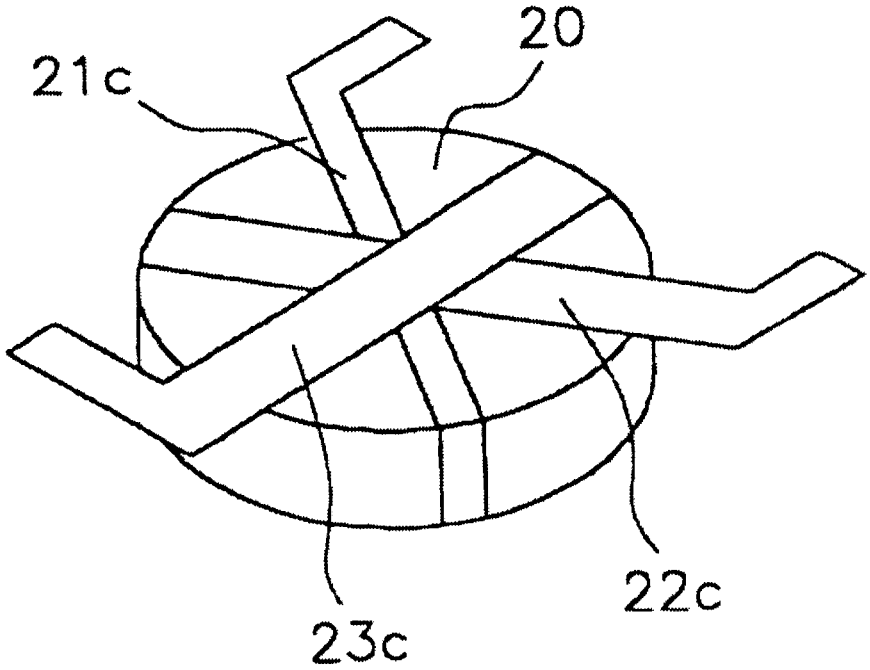
FIG. 6 is another modification of the nonreciprocal circuit device according to the second embodiment of the present invention.

Referring to FIG. 6, a description will be given of a second modification of the second embodiment. Since this is nearly the same as the above second embodiment, only the ferrite member part will be illustrated with reference to FIG. 6.

As shown in FIG. 6, the central conductors 21*c*, 22*c*, and 23*c* formed on the ferrite member 20 of this embodiment have different widths respectively. Since the central conductors 21*c*, 22*c*, and 23*c* are overlapped to mutually intersect with an insulation film (not shown), the distances between the ferrite member 20 and the central conductors 21*c*, 22*c* and 23*c*, are different respectively. That is, since the central conductors 21*c*, 22*c*, and 23*c* have different respective effective dielectric constants, when the central conductors having the same widths are formed, there are variations in the characteristic impedance thereof. Thus, for example, such variations may cause the bandwidths between the input/output terminals to have different values. However, as shown in FIG. 6, making the width of the central conductor 23*c* disposed on the top larger than the widths of the central conductors 21*c* and 22*c* on the lower side permits the characteristic impedance in the respective central conductors to be set to the same value, so that the bandwidths between the respective input/output terminals can be set to be equal. In addition, the ability to set the widths of the central conductors 21*c*, 22*c*, and 23*c* to arbitrary values permits the characteristics of bandwidth or the like in the nonreciprocal circuit device to be arbitrarily set.

In the above-described embodiment, although a three-terminal nonreciprocal circuit device is used, a two-terminal nonreciprocal circuit device can also be used in the present invention.

Figure 7:
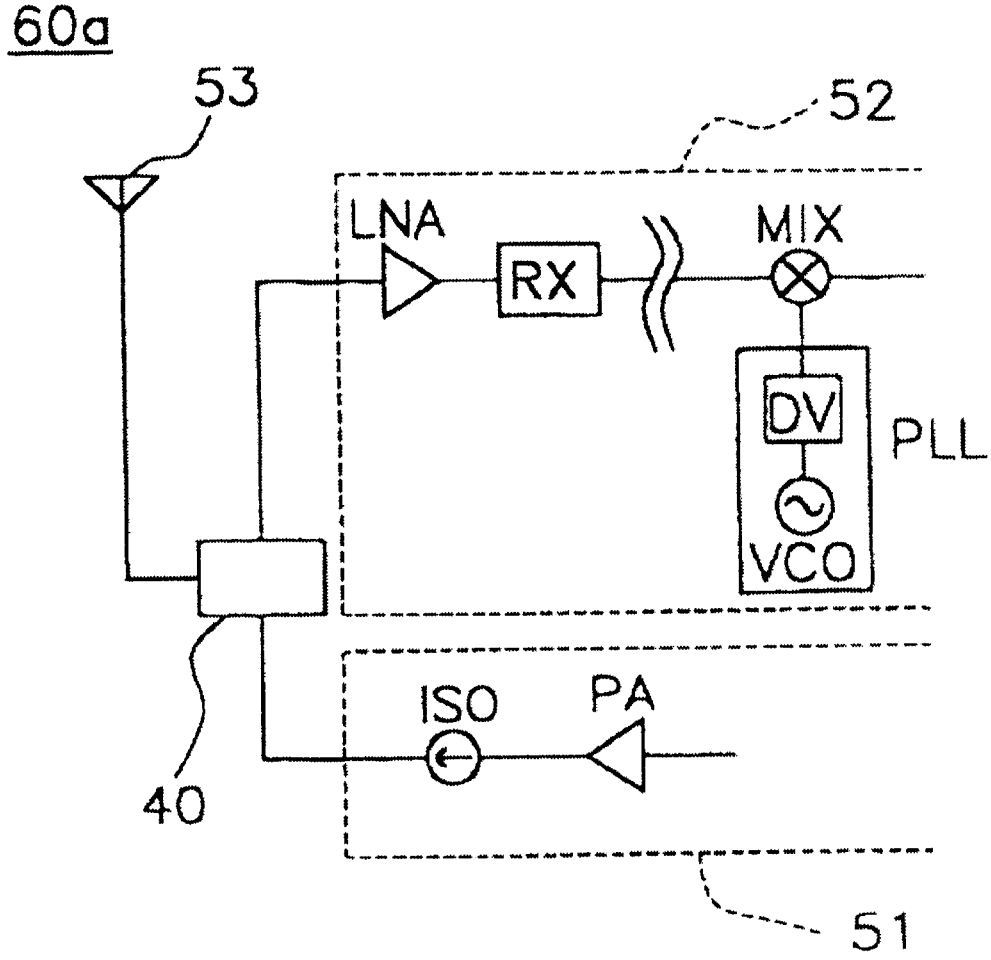
FIG. 7 is a schematic view of a communications device according to a first embodiment of the present invention.

Furthermore, a communications device 60*a* in accordance with the present invention will be illustrated referring to FIG. 7. FIG. 7 is a schematic view of the communications device used in the present invention.

As shown in FIG. 7, the communications device 60*a* of the present invention comprises a duplexer 40 constituting a transmitting filter and a receiving filter, an antenna 53 for connecting to an antenna connector of the duplexer 40, a transmitting circuit 51 for connecting to the input/output connector disposed on the transmitting filter side of the duplexer 40, and a receiving circuit 52 for connecting to the input/output connector disposed on the receiving filter side of the duplexer 40.

The transmission circuit 51 has a power amplifier (PA), which amplifies transmission signals. The amplified signals, after passing through an isolator (ISO), are transmitted from the antenna 53 through the transmitting filter. In addition, received signals are sent to the receiving circuit 52 from the antenna 53 through the receiving filter. Then, after passing through a low-noise amplifier (LNA), a filter (RX), etc., in the receiving circuit 52, the receiving signals are input to a mixer (MIX). A local oscillator is formed of a phase-locked loop (PLL) comprising an oscillator (VCO) and a divider (DV). This oscillator outputs local signals to the mixer, from which, in turn, an intermediate frequency is output.

This arrangement can provide the communications device 60*a* incorporating a nonreciprocal circuit device of reduced size.

Figure 8:
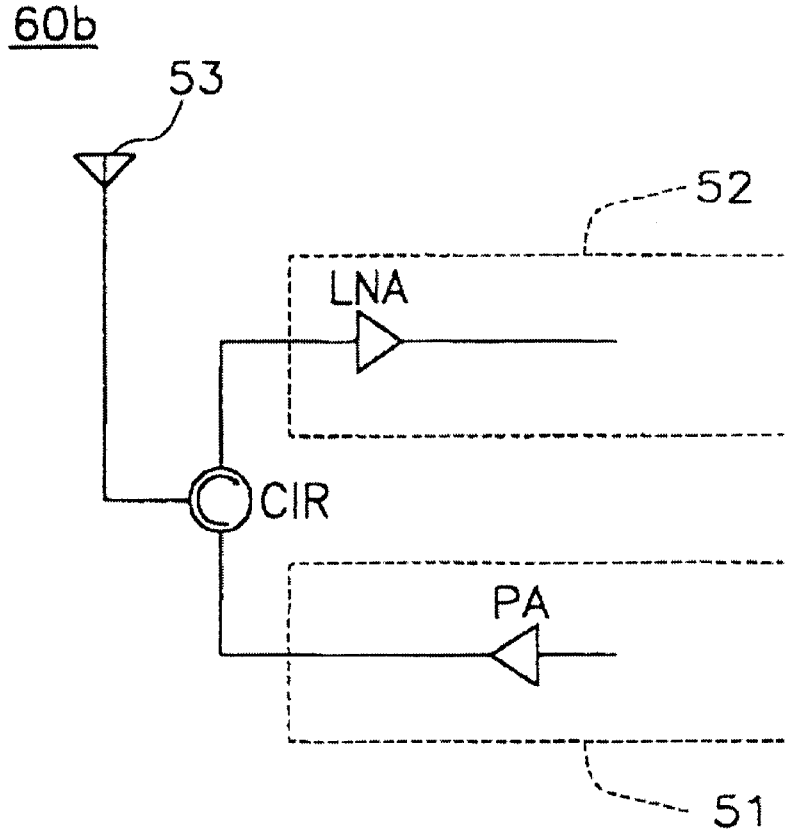
FIG. 8 is a schematic view of a communications device according to a second embodiment of the present invention.
Figure 9:
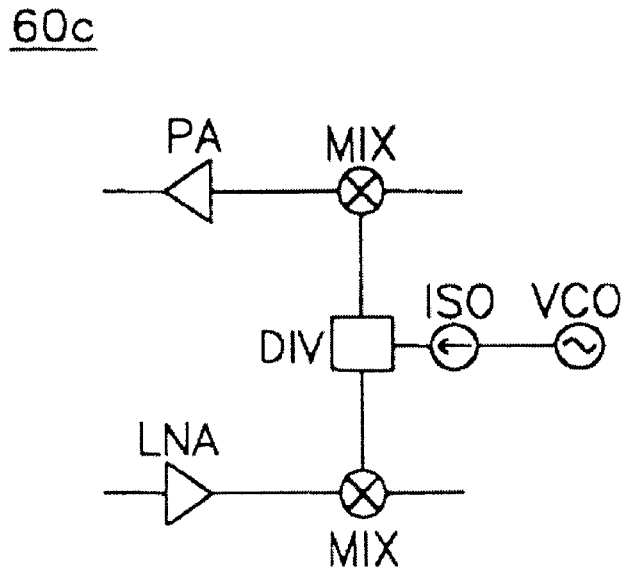
FIG. 9 is a schematic view of a communications device according to a third embodiment of the present invention.
Figure 10:
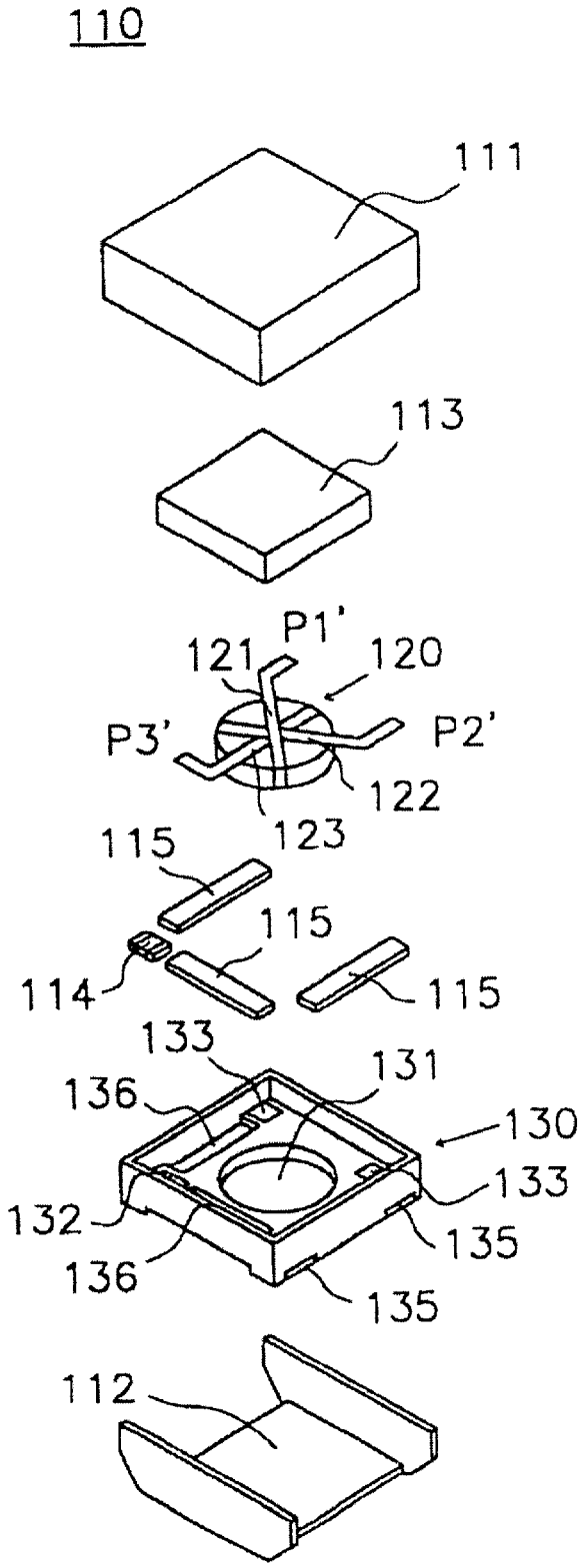
FIG.10 PRIOR ART
FIG. 10 is an exploded perspective view of a conventional lumped-constant nonreciprocal circuit device.
Figure 11:
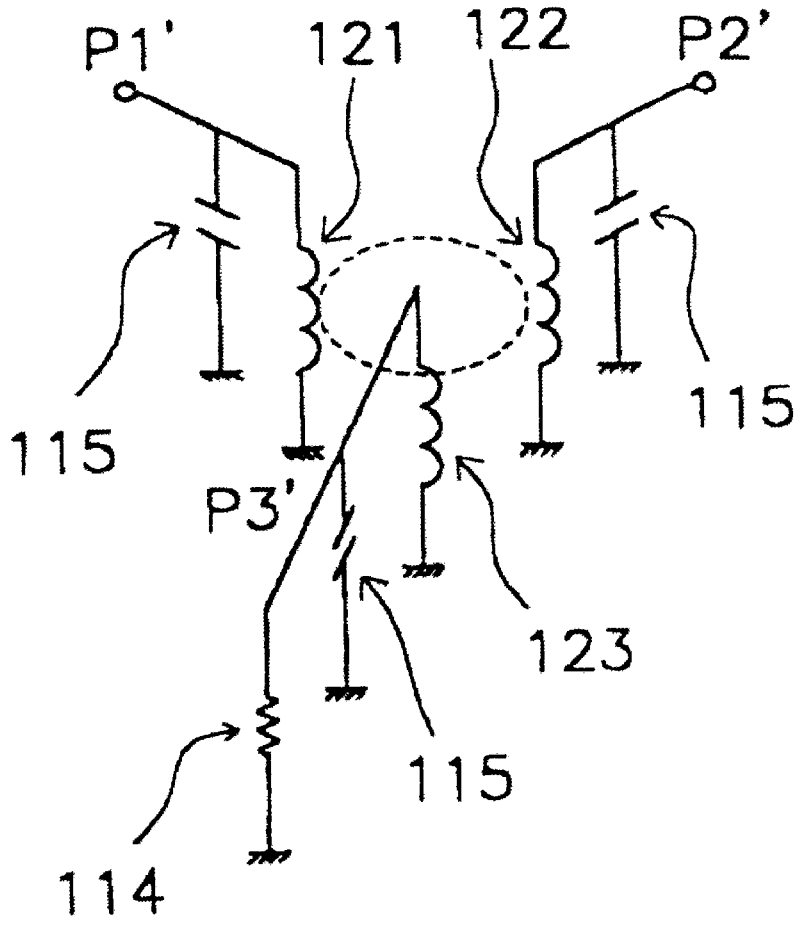
FIG. 11 PRIOR ART
FIG. 11 is an equivalent circuit diagram of the conventional lumped-constant nonreciprocal circuit device.
Figure 12:
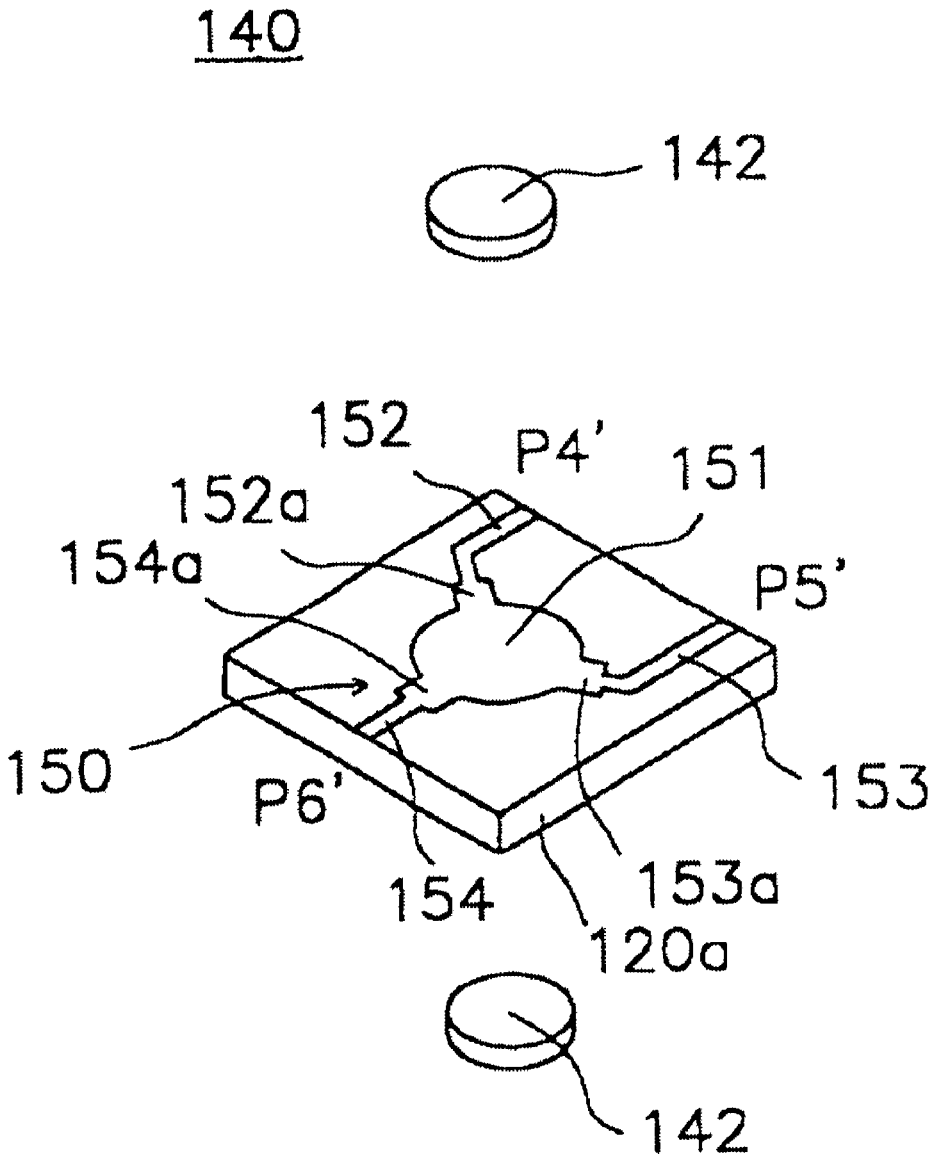
FIG. 12 PRIOR ART
FIG. 12 is an exploded perspective view of a conventional distributed-constant nonreciprocal circuit device.

The communications device of the present invention should not be limited to the above embodiment. For example, a nonreciprocal circuit device can be included in a receiving circuit. Or, a communications device 60*b* shown in FIG. 8 or a communications device 60*c* shown in FIG. 9 can be applied to this invention. That is, the communications device 60*b* shown in FIG. 8 comprises an antenna 53, a circulator (CIR) for connecting to the antenna 53, a transmission circuit 51 and a receiving circuit 52 for connecting to the circulator (CIR). The transmission circuit incorporates a power amplifier (PA) and the like, whereas the receiving circuit incorporates a low-noise amplifier (LNA) and the like. The communications device 60*c* shown in FIG. 9 comprises a power amplifier (PA) incorporated in the transmission circuit, a mixer (MIX) connected to the power amplifier, a low-noise amplifier (LNA) incorporated in the receiving circuit, a mixer (MIX) connected to the low-noise amplifier, a divider (DIV) connected to both mixers (MIX), and an oscillator (VCO) connected to the divider (DIV). An isolator (ISO) is connected between the divider (DIV) and the oscillator (VCO).

As described above, the length of the central conductor formed in proximity to the ferrite member is set to be approximately n·λg/2 (n=a natural number) with respect to a wavelength λg at a usable frequency. This arrangement permits the central conductor to serve as a λg/2-wavelength resonator, in which a DC magnetic field is applied so as to obtain nonreciprocal properties. Furthermore, no impedance converter need be connected, unlike the case of a conventional Y-shaped distributed-constant nonreciprocal circuit device, so that the nonreciprocal circuit device of the present invention can be reduced in size. In addition, setting the length of the central conductor to be substantially $(2m-1)\cdot\lambda g/4$ (m=a natural number) with respect to a wavelength λg at a usable frequency permits the nonreciprocal circuit device to be even smaller than that in the case of the central conductor having a length of $n\cdot\lambda g/2$.

Although the present invention has been described in relation to particular embodiments thereof, many other variations and modifications and other uses will become apparent to those skilled in the art. Therefore, the present invention is not limited by the specific disclosure herein.

What is claimed is:

1. A nonreciprocal circuit device comprising:

a magnetic body;

a plurality of mutually intersecting central conductors disposed in proximity to said magnetic body; and a magnet for applying a DC magnetic field to said central conductors;

wherein a plurality of central conductors have lengths of substantially $n\cdot\lambda g/2$, n being a natural number, λg being the wavelength of a usable frequency, and with one end of each of the central conductors being connected to an input/output terminal of said non-reciprocal circuit device and the other end thereof being electrically open.

2. A nonreciprocal circuit device according to claim 1, wherein at least two of the central conductors have different widths.

3. A nonreciprocal circuit device according to claim 1, wherein the central conductors have lengths of substantially λg/2.

4. A nonreciprocal circuit device according to claim 3, wherein at least two of the central conductors have different widths.

5. A nonreciprocal circuit device comprising:

a magnetic body;

a plurality of mutually intersecting central conductors disposed in proximity to said magnetic body; and a magnet for applying a DC magnetic field to said central conductors;

wherein the plurality of central conductors have lengths of substantially $(2m-1)\cdot\lambda g/4$, m being a natural number, λg being the wavelength of a usable frequency, and with one end of each of the central conductors being connected to an input/output terminal of said nonreciprocal circuit device and the other end thereof being connected to a ground terminal.

6. A nonreciprocal circuit device according to claim 5, wherein at least two of the central conductors have different widths.

7. A nonreciprocal circuit device according to claim 5, wherein the central conductors have lengths of substantially λg/4.

8. A nonreciprocal circuit device according to claim 7, wherein at least two of the central conductors have different widths.

9. A communications device comprising:

a transmitting circuit;

a receiving circuit; and a nonreciprocal circuit device, said nonreciprocal circuit device comprising:

a magnetic body;

a plurality of mutually intersecting central conductors disposed in proximity to said magnetic body; and a magnet for applying a DC magnetic field to said central conductors;

wherein a plurality of central conductors have lengths of substantially $n\cdot\lambda g/2$, n being a natural number, λg being the wavelength of a usable frequency, and with one end of each of the central conductors being connected to an input/output terminal of said non-reciprocal circuit device and the other end thereof being electrically open; and said nonreciprocal circuit device being connected to one of said transmitting circuit and said receiving circuit.

10. A communications device comprising:

a transmitting circuit;

a receiving circuit; and a nonreciprocal circuit device, said nonreciprocal circuit device comprising:

a magnetic body;

a plurality of mutually intersecting central conductors disposed in proximity to said magnetic body; and a magnet for applying a DC magnetic field to said central conductors;

wherein the plurality of central conductors have lengths of substantially $(2m-1)\cdot\lambda g/4$, m being a natural number, λg being the wavelength of a usable frequency, and with one end of each of the central conductors being connected to an input/output terminal of said nonreciprocal circuit device and the other end thereof being connected to a ground terminal; and said nonreciprocal circuit device being connected to one of said transmitting circuit and said receiving circuit.

* * * * *